United States Patent [19]

Reed

[11] 3,934,450

[45] Jan. 27, 1976

[54] METHOD AND APPARATUS FOR BENDING ELONGATED MEMBERS

[75] Inventor: Winthrop B. Reed, St. Louis, Mo.

[73] Assignee: General Steel Industries, Inc., St. Louis, Mo.

[22] Filed: Aug. 12, 1974

[21] Appl. No.: 496,374

[52] U.S. Cl. ..... 72/383; 72/309; 72/369; 72/399

[51] Int. Cl.[2] ..... B21D 5/02

[58] Field of Search ..... 72/383, 369, 399, 401, 72/465, 466, 389, 403, 308, 309, 311, 298, 300, 306, 353, 471

[56] References Cited

UNITED STATES PATENTS

| | | | |
|---|---|---|---|
| 201,607 | 3/1878 | Harty | 72/383 |
| 1,923,272 | 8/1933 | Maroto | 72/369 |
| 2,437,092 | 3/1948 | Greene et al. | 72/389 |
| 2,487,810 | 11/1949 | Hunt | 72/383 |
| 2,516,372 | 7/1950 | Cross | 72/369 |
| 2,555,695 | 6/1951 | Knight et al. | 72/309 |
| 2,986,194 | 5/1961 | Marco | 72/399 |
| 3,004,584 | 10/1961 | Fuchs et al. | 72/298 |
| 3,667,274 | 6/1972 | Cape | 72/298 |
| 3,831,419 | 8/1974 | Leese et al. | 72/298 |

*Primary Examiner*—C. W. Lanham
*Assistant Examiner*—James R. Duzan
*Attorney, Agent, or Firm*—F. Travers Burgess

[57] ABSTRACT

A method and apparatus is provided for bending elongated members such as pipe sections by the application of axial compression to both ends of a pipe section positioned between parallel guides. Preferably the apparatus comprises a pair of fittings with pivot mountings receivable in both ends of the pipe section, means for forcing the fittings toward each other in a direction axial of the pipe and for initially applying slight transverse pressure to the pipe section intermediate its ends in a direction radially outward with respect to the desired bend, and parallel planar guides on opposite sides of the pipe section.

12 Claims, 2 Drawing Figures

METHOD AND APPARATUS FOR BENDING ELONGATED MEMBERS

BACKGROUND OF THE INVENTION

1. Field of the Invention

The invention relates to a method and apparatus for bending elongated members, particularly those of tubular shape.

2. The Prior Art

Conventional methods of bending elongated members, such as pipe sections, consist of restraining the ends of the pipe section against transverse movement, placing the pipe section against a convex inner shoe, and moving the shoe radially outwardly of the desired bend. The application of this method to coated pipe is likely to damage the coating because of the necessary high pressure engagement of the shoe with surface portions of the coated pipe section surface.

SUMMARY OF THE INVENTION

The invention provides means for bending elongated members, such as pipe sections with minimum application of radial or transverse forces to the longitudinal surfaces of the pipe section. This is achieved by the application of axial compressive forces to the ends of a section of pipe held against any movement transverse to the plane of the arc through which it is to be bent, and initially biased radially outwardly with respect to the desired bend. Means is also provided to limit the curvature of the pipe.

This method and the apparatus for performing it are highly desirable for bending coated pipe, because of the absence of reliance principally on the application of transverse forces to the coated surface of the pipe to achieve the bending.

DETAILED DESCRIPTION OF THE INVENTION

Figure 1:
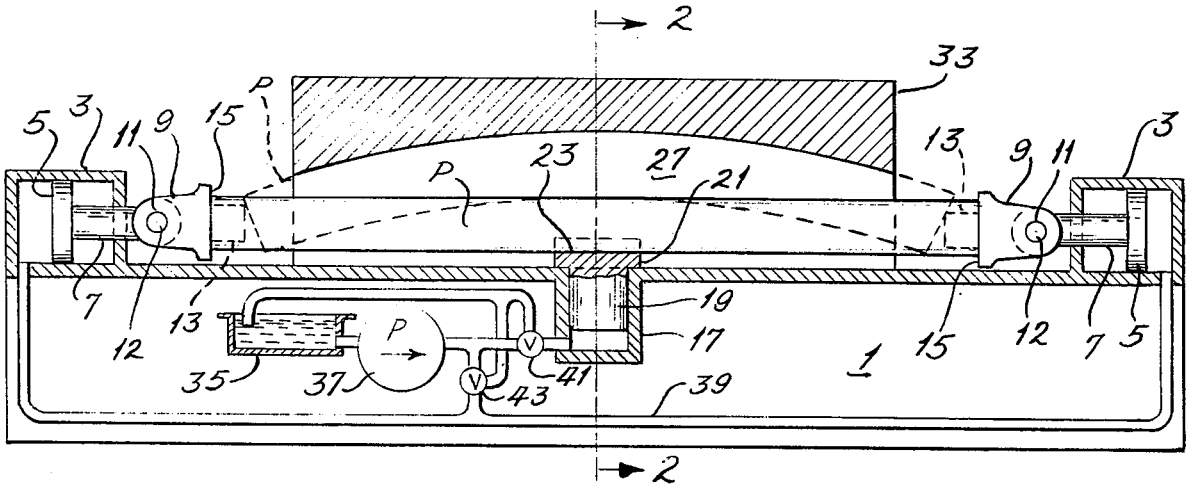
FIG. 1 is a diagrammatic longitudinal vertical sectional view of apparatus embodying the invention.
Figure 2:
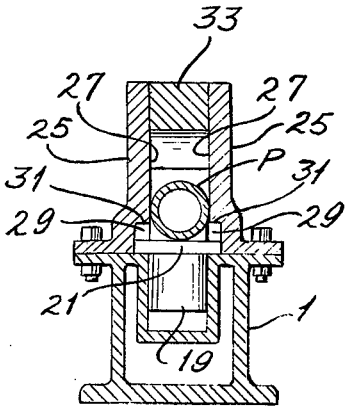
FIG. 2 is a transverse vertical sectional view along line 2—2 of FIG. 1.

The invention utilizes apparatus comprising a base 1, mounting a pair of opposed horizontal, axially aligned hydraulic cylinders 3 at its ends. Each cylinder 3 includes a piston 5 having a rod 7 nonrotatable protruding from cylinder 3. A pair of axially spaced apart pivot pipe mounting fittings each comprises a clevis-like body 9 formed with transverse pivot pin holes 11 at one end and a reduced diameter cylindrical boss 13 at the other end, surrounded by a pipe end engaging annular shoulder 15.

Fittings 9–15 are pivotally secured by pins 12, respectively, to the ends of piston rods 7, for limited pivotal movement solely in the plane of the proposed bend and for axial movement toward each other when cylinders 3 are activated.

Intermediate fittings 9–15, base 1 is formed with a vertical hydraulic cylinder 17 in which is vertically slidably mounted a piston 19 formed with an upwardly protruding enlarged head 21 having a slightly convex crown 23 adapted for tangential engagement with the midpoint of pipe P. Pipe section P is mounted on fittings 9–15 with bosses 13 snugly received within its ends and its end surfaces in abutting engagement with shoulders 15.

To assure that pipe section P will bend only in desired directions, parallel guide members 25 are mounted on both sides of base 1 with inner plane surfaces 27 parallel to each other and spaced apart sufficiently to receive pipe section P between them. Plane surfaces 27 are normal to the axis about which the pipe section is to be bent and are recessed at 29 to accommodate enlarged head 21 of vertical piston 19 and to form shoulders 31 limiting upward movement of head 21 to a height sufficient to engage the pipe only at the beginning of the bending operation and thus bias it in the direction of the desired bend, which is completed by the action of the longitudinal forces applied to the pipe by fittings 9, 15.

For limiting the curvature of pipe P, a concave die or other suitable means having a concavity of the same radius as the desired bend in pipe P is mounted between guides 25 in suitably spaced vertical relation with the top of base 1.

A hydraulic system for actuating cylinders 3 and 17 may include a reservoir 35, pump 37 and suitable piping 39 including control valves 41 and 43 for cylinders 17 and 3 respectively.

The method of bending pipe section P comprises the steps of opening valve 43 to actuate cylinder 3 and thereby apply pressure through fittings 9–15 to the ends of section P, then opening valve 41 to actuate cylinder 17 and move pivton 19 upwardly so that in accordance with Euler's principle section P will begin to bend when the pressure on its ends reaches a critical value, the bending being in the direction of concave die 33 since the tangential engagement of vertical piston crown 23 with pipe P and the outward movement of piston crown 31 prevents bending inwardly and the engagement of pipe P with plane guide surfaces 15 prevents bending in directions parallel to the axis of die 33. The pipe will continue to bend until pressure is removed from its ends, or until its surface engages concave die 33.

Because of the principal reliance on axial forces and the minimal application of transverse forces (through vertical piston crown 23) to the pipe, no damage will be done to the pipe surface or, if the pipe is coated, to the coating.

It will be understood that details of the disclosed apparatus and method may be varied as will occur to those skilled in the art without departing from the spirit of the invention and the exclusive use of all modifications as come within the scope of the appended claims is contemplated.

I claim:

1. The method of bending an elongated member comprising the steps of positioning the elongated member between a pair of parallel surfaces normal to the axis of the proposed bend and spaced apart sufficiently to closely receive the width of the elongated member between them, initiating application of longitudinal compressive loads to opposite ends of the elongated member, applying a transverse load in a direction radially outwardly of the direction of the proposed bend to the intermediate region of the elongated member, ceasing application of such transverse load prior to substantial bending of the elongated member, and continuing application of such longitudinal compressive loads after cessation of application of said transverse load, to complete the bending operation.

2. The method according to claim 1 wherein the intermediate region of said elongated member is biased radially outwardly by a member engaging the radially inner longitudinal surface portion of said elongated member intermediate its ends, and arranged for limited movement in a direction radially outwardly of the proposed bend.

3. The method according to claim 1 wherein the longitudinal compressive loads are applied to the elongated member ends by fittings each having a transverse surface portion abuttingly engageable with an end surface of the elongated member and a portion matingly engageable with an end portion of the elongated member.

4. The method according to claim 3 wherein each of said fittings includes a pivotal mounting with its axis parallel to the axis of the desired bend.

5. The method according to claim 3 wherein the elongated member is of tubular shape and said matingly engageable portion is matingly receivable within the end of the elongated member.

6. Apparatus for bending elongated members comprising spaced parallel surface means normal to the axis of the proposed bend engageable with opposite longitudinal surface portions of an elongated member to restrain the member from bending in the direction of either of said surface portions, compression-transmitting means engageable with the opposite end surfaces of the elongated member and means for forcing said compression-transmitting means toward each other in a direction generally axial of the elongated member, additional surface means engageable with the radially inward surface portion of the elongated member intermediate its ends, and means for moving said additional surface means radially outwardly a limited distance sufficient to engage the intermediate portion of the elongated member only at the beginning of the bending operation.

7. Apparatus according to claim 6 including other surface means spaced from said additional surface means for engagement with the radially outward surface of said elongated member opposite said third surface after initiation of bending action to limit the extent of the bend.

8. Apparatus according to claim 6 wherein said parallel surface means comprises parallel plate-like members having opposed plane surfaces.

9. Apparatus according to claim 6 wherein said additional surface means comprises a piston member positioned for initial tangential engagement with the radially inward surface of said elongated member intermediate its ends and movable radially outwardly in the direction of the proposed bend, there being stop means limiting travel of said piston member to a stroke sufficient to engage the elongated member only at the beginning of the bending operation.

10. Apparatus according to claim 6 wherein each said compression-transmitting means has a transverse surface abuttingly engageable with an end surface of the elongated member, a portion matingly engageable with the end portion of the elongated member, and a pivot mounting portion with its axis normal to the plane of the desired bend for pivotal connection to said forcing means.

11. Apparatus according to claim 10 wherein the elongated member is of tubular shape and said matingly engageable portion is a boss of similar cross section to the inner surface of the elongated member.

12. Apparatus according to claim 7 wherein said other surface means comprises a concave arcuate die member concentric with the axis of the proposed bend.

* * * * *